US006948841B2

(12) United States Patent
Tsai

(10) Patent No.: US 6,948,841 B2
(45) Date of Patent: Sep. 27, 2005

(54) LIGHT EMITTING DECORATIVE APPARATUS

(76) Inventor: Lee-Hsueh Tsai, 58, Ma Yuan West St., Taichung (TW)

( * ) Notice: Subject to any disclaimer, the term of this patent is extended or adjusted under 35 U.S.C. 154(b) by 36 days.

(21) Appl. No.: 10/770,042

(22) Filed: Jan. 30, 2004

(65) Prior Publication Data

US 2005/0169011 A1 Aug. 4, 2005

(51) Int. Cl.[7] ..... A47G 35/00
(52) U.S. Cl. ..... 362/565; 362/276; 362/806
(58) Field of Search ..... 362/565, 555, 362/276, 800, 806

(56) References Cited

U.S. PATENT DOCUMENTS 6,039,453 A * 3/2000 Wang ..... 362/101
6,135,606 A * 10/2000 Fernandez et al. ..... 362/109
6,269,566 B1 * 8/2001 Lo ..... 40/406
6,517,217 B1 * 2/2003 Liao ..... 362/235
6,820,998 B2 * 11/2004 Chen ..... 362/276

* cited by examiner

*Primary Examiner*—Ali Alavi
(74) *Attorney, Agent, or Firm*—Alan D. Kamrath; Nikolai & Mersereau, P.A.

(57) ABSTRACT

A light emitting decorative apparatus includes a main frame, a socket, a cover, a soft rubber jacket, and an ornament. Thus, when the protruding probe detects existence of the water, and when the optical sensitive resistor detects that the light is weakened to a determined extent, the optical sensitive resistor triggers the circuit board to drive the light emitting diode to emit light outward, and the optical fibers conduct the light to the ornament, so that the ornament lights and blinks, thereby greatly enhancing the aesthetic quality of the light emitting decorative apparatus.

12 Claims, 4 Drawing Sheets

LIGHT EMITTING DECORATIVE APPARATUS

BACKGROUND OF THE INVENTION

1. Field of the Invention

The present invention relates to a decorative apparatus, and more particularly to a water sensing light emitting decorative apparatus that saves the electric energy.

2. Description of the Related Art

A conventional ornament is placed in the water of an aquarium, a pool, a pond or the like, to provide a decorative effect so as to enhance the aesthetic quality thereof. However, the conventional ornament has a fixed pattern and lacks variation, thereby decreasing the attractive effect thereof. In addition, it is necessary to provide a light source projected onto the ornament to present the outer appearance of the ornament at the darker state, thereby limiting the versatility of the ornament.

SUMMARY OF THE INVENTION

The primary objective of the present invention is to provide a water sensing light emitting decorative apparatus that saves the electric energy.

Another objective of the present invention is to provide a light emitting decorative apparatus, wherein when the optical sensitive resistor detects that the light is darker, the optical sensitive resistor triggers the circuit board to drive the light emitting diode to emit light outward, and the optical fibers conduct the light to the ornament, so that the ornament lights and blinks, thereby greatly enhancing the aesthetic quality of the light emitting decorative apparatus.

A further objective of the present invention is to provide a light emitting decorative apparatus, wherein the circuit board is triggered to light the light emitting diode only when the protruding probe detects existence of the water, and when the optical sensitive resistor detects that the light is weakened to a determined extent, thereby saving the electrical energy.

A further objective of the present invention is to provide a light emitting decorative apparatus, wherein the light emitting decorative apparatus needs not to be externally connected to a power supply, thereby facilitating the user operating the light emitting decorative apparatus.

In accordance with the present invention, there is provided a light emitting decorative apparatus, comprising:

- a main frame including a substantially cylindrical battery box, a circuit board mounted on a top face of the battery box, a light emitting diode mounted on a top face of the circuit board, a probe mounted on a bottom face of the circuit board, and an optical sensitive resistor mounted on the bottom face of the circuit board;
- a socket mounted on the main frame and having an upper end formed with a first through hole for passage of the probe and a second through hole for passage of the optical sensitive resistor;
- a cover mounted on the upper end of the socket to seal the main frame between the cover and the socket and having a top face formed with a mounting tube; and
- an ornament mounted on the top face of the cover and having a top face provided with a plurality of optical fibers and a bottom face formed with a substantially cylindrical insert inserted into the mounting tube of the cover.

Further benefits and advantages of the present invention will become apparent after a careful reading of the detailed description with appropriate reference to the accompanying drawings.

DETAILED DESCRIPTION OF THE INVENTION

Figures 1, 1A:
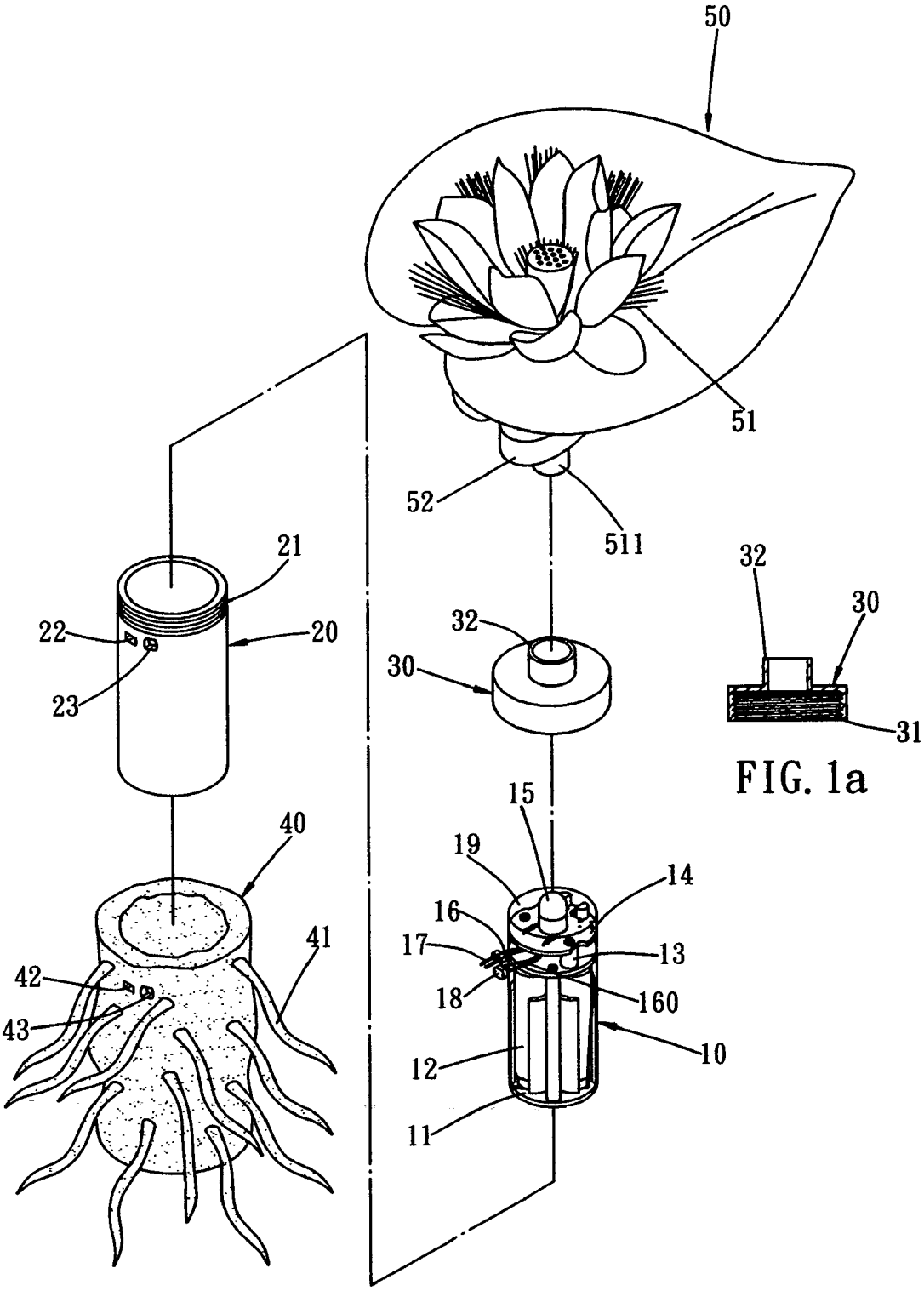
FIG. 1 is an exploded perspective view of a light emitting decorative apparatus in accordance with the preferred embodiment of the present invention.
FIG. 1*a* is a plan cross-sectional view of a cover of the light emitting decorative apparatus as shown in FIG. 1.
Figure 2:
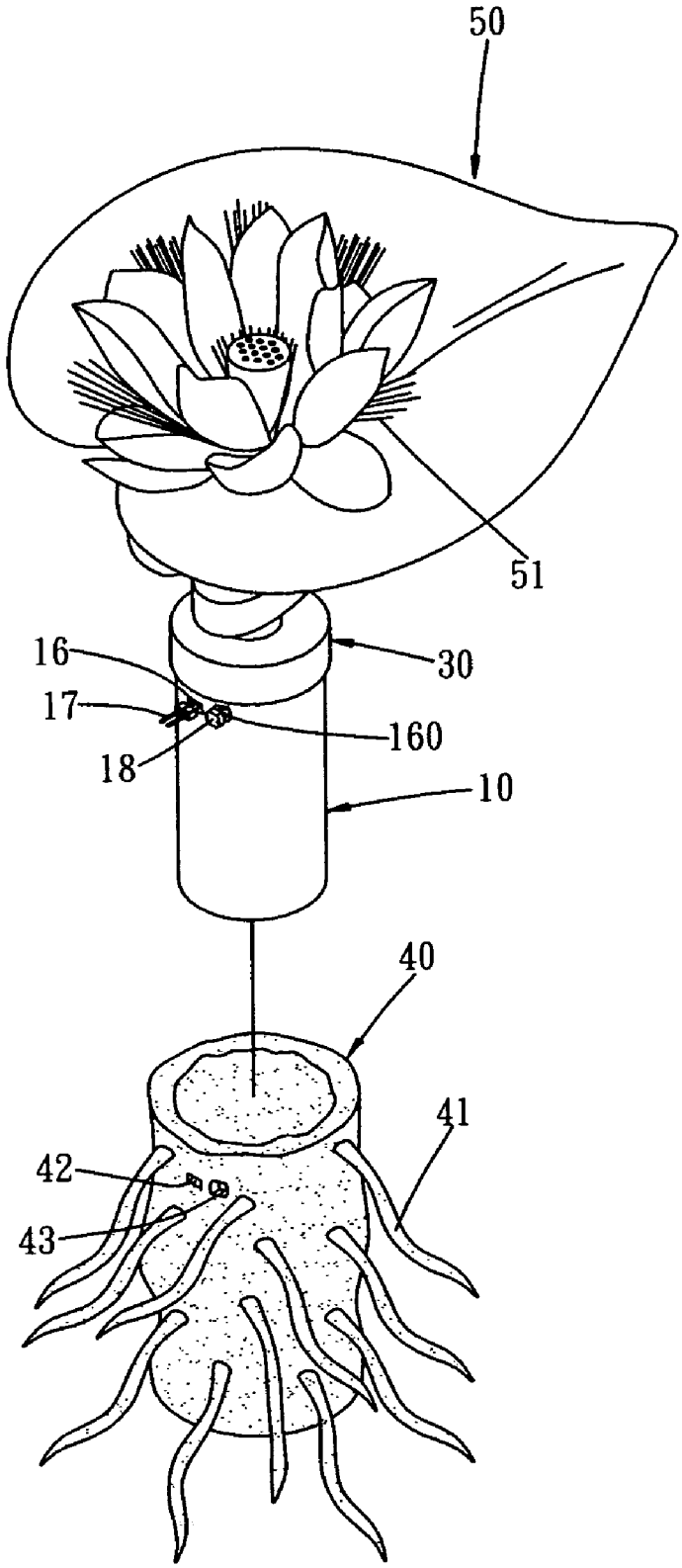
FIG. 2 is a partially exploded perspective view of the light emitting decorative apparatus in accordance with the preferred embodiment of the present invention.
Figure 3:
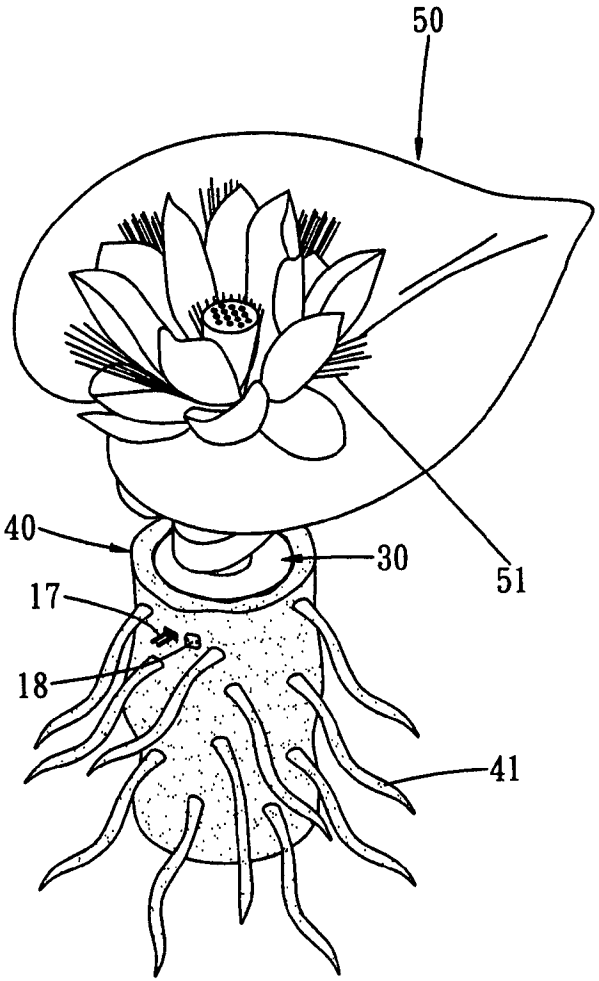
FIG. 3 is a perspective assembly view of the light emitting decorative apparatus in accordance with the preferred embodiment of the present invention.

Referring to the drawings and initially to FIGS. 1–3, a light emitting decorative apparatus in accordance with the preferred embodiment of the present invention comprises a main frame 10, a socket 20, a cover 30, a soft rubber jacket 40, and an ornament 50.

The main frame 10 includes a substantially cylindrical battery box 11, a plurality of batteries 12 mounted in the battery box 11, a circuit board 14 mounted on a top face of the battery box 11 by a plurality of support posts 13, a light emitting diode (LED) 15 mounted on a top face of the circuit board 14, a probe 17 mounted on a bottom face of the circuit board 14 and connected to the circuit board 14 by a first conducting wire 16, an optical sensitive resistor 18 mounted on the bottom face of the circuit board 14 and connected to the circuit board 14 by a second conducting wire 160, and a resin 19 coated on a periphery of the circuit board 14 with the light emitting diode 15, the probe 17 and the optical sensitive resistor 18 protruding outward from the resin 19.

The socket 20 is mounted on the main frame 10 and has an upper end formed with an outer thread 21, a first through hole 22 for passage of the probe 17 and a second through hole 23 for passage of the optical sensitive resistor 18.

The cover 30 is mounted on the upper end of the socket 20 to seal the main frame 10 between the cover 30 and the socket 20. The cover 30 has an inside formed with an inner thread 31 (see FIG. 1*a*) screwed onto the outer thread 21 of the socket 20, so that the cover 30 is secured on the upper end of the socket 20. The cover 30 has a top face formed with a mounting tube 32.

The rubber jacket 40 is mounted on the socket 20 and has an upper end formed with a first mounting hole 42 for mounting the probe 17 and a second mounting hole 43 for mounting the optical sensitive resistor 18. The rubber jacket 40 has a periphery formed with a plurality of ornamental strips 41.

The ornament 50 is mounted on the top face of the cover 30 and has a top face provided with a plurality of optical fibers 51 and a bottom face formed with a substantially cylindrical insert 511 inserted into the mounting tube 32 of the cover 30. The insert 511 has an upper end provided with a floating board 52. Preferably, the optical fibers 51 are arranged in a radiating manner.

Figure 4:
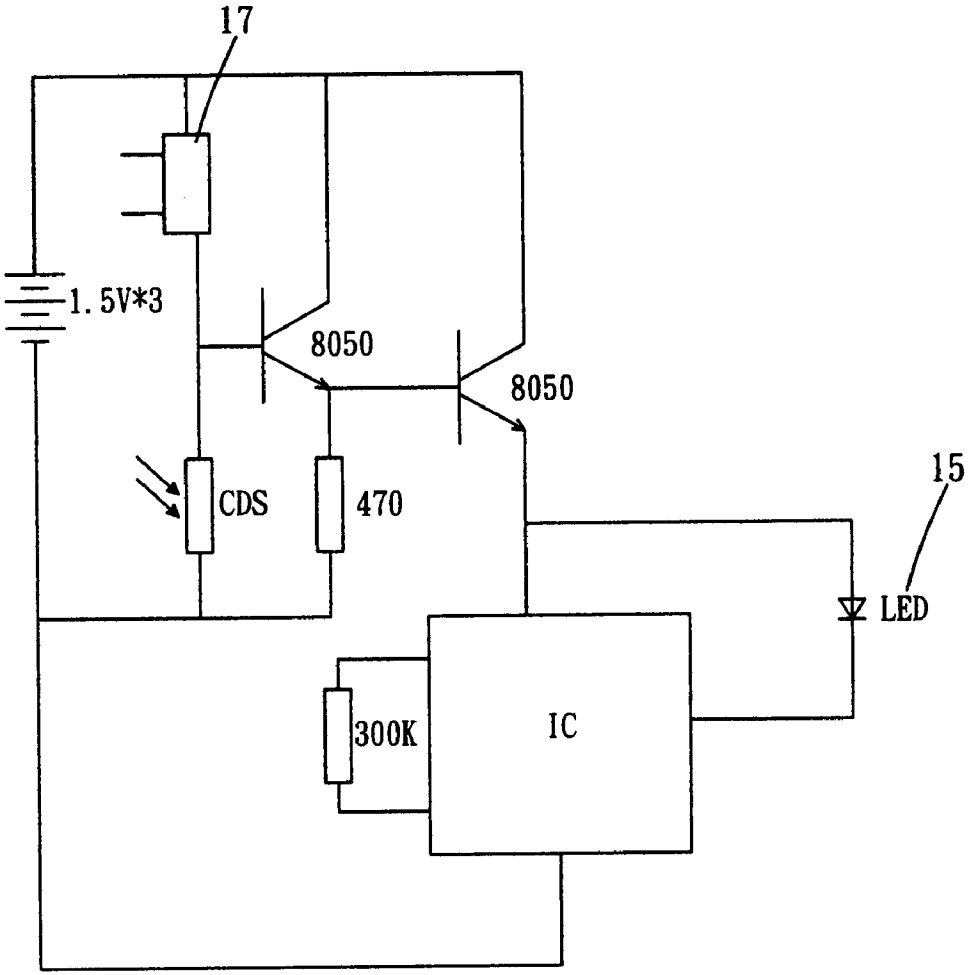
FIG. 4 is a circuit view of the light emitting decorative apparatus in accordance with the preferred embodiment of the present invention.

When in use, referring to FIG. 4 with reference to FIGS. 1–3, when the light emitting decorative apparatus is placed in the water of an aquarium, a pool, a pond or the like, the protruding probe 17 of the main frame 10 detects existence of the water, and the optical sensitive resistor 18 of the main frame 10 detects existence of the light source. When the optical sensitive resistor 18 detects that the light source has a greater strength at the daytime, the circuit board 14 of the main frame 10 is disposed at a closed state, thereby saving the electrical energy. When the optical sensitive resistor 18 detects that the light source has a smaller strength at the night, the optical sensitive resistor 18 triggers the circuit board 14 to drive the light emitting diode 15 to emit light outward, and the optical fibers 51 conduct the light to the ornament 50, so that the ornament 50 lights and blinks, thereby greatly enhancing the aesthetic quality of the light emitting decorative apparatus.

Accordingly, when the optical sensitive resistor 18 detects that the light is darker, the optical sensitive resistor 18 triggers the circuit board 14 to drive the light emitting diode 15 to emit light outward, and the optical fibers 51 conduct the light to the ornament 50, so that the ornament 50 lights and blinks, thereby greatly enhancing the aesthetic quality of the light emitting decorative apparatus.

In addition, the circuit board 14 is triggered to light the light emitting diode 15 only when the protruding probe 17 detects existence of the water, and when the optical sensitive resistor 18 detects that the light is weakened to a determined extent, thereby saving the electrical energy.

Further, the light emitting decorative apparatus needs not to be externally connected to a power supply, thereby facilitating the user operating the light emitting decorative apparatus.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A light emitting decorative apparatus, comprising:

a main frame including a substantially cylindrical battery box, a circuit board mounted on a top face of the battery box, a light emitting diode mounted on a top face of the circuit board, a probe mounted on a bottom face of the circuit board, and an optical sensitive resistor mounted on the bottom face of the circuit board;

a socket mounted on the main frame and having an upper end formed with a first through hole for passage of the probe and a second through hole for passage of the optical sensitive resistor;

a cover mounted on the upper end of the socket to seal the main frame between the cover and the socket and having a top face formed with a mounting tube; and an ornament mounted on the top face of the cover and having a top face provided with a plurality of optical fibers and a bottom face formed with a substantially cylindrical insert inserted into the mounting tube of the cover.

2. The light emitting decorative apparatus in accordance with claim 1, wherein the main frame further includes a plurality of batteries mounted in the battery box.

3. The light emitting decorative apparatus in accordance with claim 1, wherein the circuit board is mounted on the top face of the battery box by a plurality of support posts.

4. The light emitting decorative apparatus in accordance with claim 1, wherein the probe is connected to the circuit board by a first conducting wire.

5. The light emitting decorative apparatus in accordance with claim 1, wherein the optical sensitive resistor is connected to the circuit board by a second conducting wire.

6. The light emitting decorative apparatus in accordance with claim 1, wherein the main frame further includes a resin coated on a periphery of the circuit board with the light emitting diode, the probe and the optical sensitive resistor protruding outward from the resin.

7. The light emitting decorative apparatus in accordance with claim 1, wherein the upper end of the socket is formed with an outer thread, and the cover has an inside formed with an inner thread screwed onto the outer thread of the socket, so that the cover is secured on the upper end of the socket.

8. The light emitting decorative apparatus in accordance with claim 1, wherein the optical fibers are arranged in a radiating manner.

9. The light emitting decorative apparatus in accordance with claim 1, wherein the insert has an upper end provided with a floating board.

10. The light emitting decorative apparatus in accordance with claim 1, further comprising soft rubber jacket mounted on the socket and having an upper end formed with a first mounting hole for mounting the probe and a second mounting hole for mounting the optical sensitive resistor.

11. The light emitting decorative apparatus in accordance with claim 10, wherein the rubber jacket has a periphery formed with a plurality of ornamental strips.

12. The light emitting decorative apparatus in accordance with claim 1, wherein when the protruding probe detects existence of the water, and when the optical sensitive resistor detects that the light is weakened to a determined extent, the optical sensitive resistor triggers the circuit board to drive the light emitting diode to emit light outward, and the optical fibers conduct the light to the ornament, so that the ornament lights and blinks.

* * * * *